US007413629B2

(12) United States Patent
Fisher et al.

(10) Patent No.: US 7,413,629 B2
(45) Date of Patent: Aug. 19, 2008

(54) PROCESS FOR PRODUCING DEEP-NESTED EMBOSSED PAPER PRODUCTS

(75) Inventors: Wayne Robert Fisher, Cincinnati, OH (US); Donn Nathan Boatman, Union, KY (US); David Mark Rasch, Cincinnati, OH (US); Nicholas Jerome Wilke, II, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 640 days.

(21) Appl. No.: 11/147,698

(22) Filed: Jun. 8, 2005

(65) Prior Publication Data

US 2005/0257879 A1 Nov. 24, 2005

Related U.S. Application Data

(63) Continuation-in-part of application No. 11/130,876, filed on May 17, 2005.

(51) Int. Cl.
*D21F 11/00* (2006.01)
*D21H 27/30* (2006.01)
*B31F 1/07* (2006.01)

(52) U.S. Cl. ..... 162/117; 162/204; 162/205; 162/207; 162/123; 162/132; 156/209; 428/156; 428/172

(58) Field of Classification Search ..... 162/109, 162/117, 123, 132, 205–207, 361, 362; 156/209; 428/156, 174, 152–154, 172; 101/3.1, 22, 101/23, 32; 425/384, 385, 394, 395, 403, 425/403.1, 404, 406–408; 264/119, 258, 264/284, 293

See application file for complete search history.

(56) References Cited

U.S. PATENT DOCUMENTS 1,863,973 A 6/1932 Ellis, Jr.

(Continued)

FOREIGN PATENT DOCUMENTS

DE 18 07 842 A1 7/1969

OTHER PUBLICATIONS

Vreeland, et al., "Substrata thermal molding, Part 1: A breakthrough in the understanding and practice of the hot calendering of paper" *Tappi Journal* (Nov. 1989), pp. 139-145.

(Continued)

*Primary Examiner*—Eric Hug
(74) *Attorney, Agent, or Firm*—Peter T. Nguyen; Peter D. Meyer; Stephen T. Murphy

(57) ABSTRACT

The present invention relates to processes for producing a deep-nested embossed paper products. The invention relates to a process for producing a deep-nested embossed paper products comprising one or more plies of paper where the resulting embossed ply or plies of paper comprise a plurality of embossments having an average embossment height of at least about 650 μm and have a high finished product wet burst strength relative to the unembossed wet strength. The present invention relates to a process for producing deep-nested embossed paper products comprising the steps of a) delivering one or more plies of paper to a deep-nested embossing process, b) conditioning the one or more plies of paper, wherein the conditioning step comprises heating the one or more plies of paper, adding moisture to the one or more plies of paper, or both heating and adding moisture to the one or more plies of paper, and c) embossing the one or more plies of the paper where the resulting embossed ply or plies of paper comprise a plurality of embossments having an average embossment height of at least about 650 μm.

8 Claims, 3 Drawing Sheets

U.S. PATENT DOCUMENTS

| | | | | |
|---|---|---|---|---|
| 2,370,811 | A | 3/1945 | Osgood, Jr. | |
| 3,097,994 | A | 7/1963 | Dickens et al. | |
| 3,238,635 | A | 3/1966 | Gravenstreter | |
| 3,414,459 | A | 12/1968 | Wells | |
| 3,556,907 | A | 1/1971 | Nystrand | |
| 3,587,177 | A | 6/1971 | Overly et al. | |
| 3,672,950 | A | 6/1972 | Murphy et al. | |
| 3,673,060 | A | 6/1972 | Murphy et al. | |
| RE27,453 | E * | 8/1972 | Schutte et al. | 162/117 |
| 3,684,603 | A | 8/1972 | Iltis | |
| 3,708,366 | A | 1/1973 | Donnelly | |
| 3,711,960 | A | 1/1973 | Overly et al. | |
| 3,776,471 | A | 12/1973 | Meyer et al. | |
| 3,782,330 | A | 1/1974 | Kanda | |
| 3,867,225 | A | 2/1975 | Nystrand | |
| 3,922,129 | A | 11/1975 | McDonald | |
| 3,938,261 | A | 2/1976 | Anderson | |
| 4,135,024 | A | 1/1979 | Callahan | |
| 4,207,143 | A | 6/1980 | Glomb et al. | |
| 4,320,162 | A | 3/1982 | Schulz | |
| 4,325,773 | A | 4/1982 | Schulz | |
| 4,326,002 | A | 4/1982 | Schulz | |
| 4,596,633 | A | 6/1986 | Attwood | |
| 4,610,743 | A | 9/1986 | Salmeen et al. | |
| 4,759,967 | A | 7/1988 | Bauernfeind | |
| 4,913,872 | A | 4/1990 | Kiss | |
| 4,913,911 | A | 4/1990 | Wildt | |
| 4,919,877 | A | 4/1990 | Parsons et al. | |
| 4,921,034 | A | 5/1990 | Burgess et al. | |
| 4,927,588 | A | 5/1990 | Schulz | |
| 4,994,144 | A | 2/1991 | Smith et al. | |
| 5,126,015 | A | 6/1992 | Pounder | |
| 5,158,819 | A | 10/1992 | Goodman, Jr. et al. | |
| 5,173,351 | A | 12/1992 | Ruppel et al. | |
| 5,294,475 | A | 3/1994 | McNeil | |
| 5,339,730 | A | 8/1994 | Ruppel et al. | |
| 5,409,572 | A | 4/1995 | Kershaw et al. | |
| 5,436,057 | A | 7/1995 | Schulz | |
| 5,468,323 | A | 11/1995 | McNeil | |
| 5,490,902 | A | 2/1996 | Schulz | |
| 5,503,896 | A | 4/1996 | Veith et al. | |
| 5,520,778 | A * | 5/1996 | Sawdai | 162/115 |
| 5,529,563 | A | 6/1996 | Veith et al. | |
| 5,536,506 | A | 7/1996 | Majeed et al. | |
| 5,573,830 | A | 11/1996 | Schulz | |
| 5,597,639 | A | 1/1997 | Schulz | |
| 5,620,776 | A | 4/1997 | Schulz | |
| 5,620,779 | A | 4/1997 | Levy et al. | |
| 5,779,965 | A | 7/1998 | Beuther et al. | |
| 5,840,404 | A | 11/1998 | Graff et al. | |
| 5,846,636 | A | 12/1998 | Ruppel et al. | |
| 5,868,168 | A | 2/1999 | Mott et al. | |
| 5,874,156 | A | 2/1999 | Schulz | |
| 5,904,812 | A | 5/1999 | Salman et al. | |
| 6,077,390 | A | 6/2000 | Salman et al. | |
| 6,077,590 | A | 6/2000 | Archer et al. | |
| 6,106,928 | A | 8/2000 | Laurent et al. | |
| 6,113,723 | A | 9/2000 | McNeil et al. | |
| 6,129,815 | A | 10/2000 | Larson et al. | |
| 6,129,972 | A | 10/2000 | McNeil et al. | |
| 6,165,319 | A | 12/2000 | Heath et al. | |
| 6,299,729 | B1 | 10/2001 | Heath et al. | |
| 6,302,998 | B1 | 10/2001 | Burgess | |
| 6,331,228 | B1 | 12/2001 | Heath et al. | |
| 6,344,111 | B1 | 2/2002 | Wilhelm | |
| 6,361,308 | B2 | 3/2002 | Wendler, Jr. | |
| 6,368,454 | B1 * | 4/2002 | Dwiggins et al. | 162/117 |
| 6,458,447 | B1 * | 10/2002 | Cabell et al. | 428/167 |
| 6,468,392 | B2 | 10/2002 | Oriarian et al. | |
| 6,524,683 | B1 | 2/2003 | Roussel et al. | |
| 6,571,673 | B2 | 6/2003 | Piazza | |
| 6,602,577 | B1 | 8/2003 | Ostendorf et al. | |
| 6,649,024 | B2 | 11/2003 | Oriarian et al. | |
| 6,699,360 | B2 | 3/2004 | Heath et al. | |
| 6,733,626 | B2 | 5/2004 | Ruthven et al. | |
| 6,755,928 | B1 | 6/2004 | Biagiotti | |
| 6,802,937 | B2 | 10/2004 | Johnston et al. | |
| 6,887,349 | B2 | 5/2005 | Ruthven et al. | |
| 6,911,573 | B2 | 6/2005 | Chen et al. | |
| 2003/0008109 | A1 | 1/2003 | Basler et al. | |
| 2003/0021953 | A1 | 1/2003 | Graff | |
| 2003/0111169 | A1 | 6/2003 | Baggot et al. | |
| 2003/0192662 | A1 | 10/2003 | Heath et al. | |
| 2003/0228444 | A1 * | 12/2003 | Johnston et al. | 428/156 |
| 2004/0038006 | A1 | 2/2004 | Biagiotti | |
| 2004/0163783 | A1 | 8/2004 | Muller | |
| 2004/0166290 | A1 | 8/2004 | Sembritzki et al. | |
| 2004/0209050 | A1 | 10/2004 | Andersson | |
| 2004/0231813 | A1 | 11/2004 | Basler et al. | |
| 2004/0247836 | A1 | 12/2004 | Biagiotti | |
| 2005/0098281 | A1 | 5/2005 | Schulz et al. | |

FOREIGN PATENT DOCUMENTS

| | | | |
|---|---|---|---|
| EP | 0 499 942 | A2 | 8/1992 |
| EP | 0 849 394 | A1 | 6/1998 |
| EP | 1 321 287 | | 1/2003 |
| EP | 1 312 466 | A1 | 5/2003 |
| EP | 1 232 854 | B1 | 4/2005 |
| GB | 2 377 674 | A1 | 1/2003 |
| WO | WO 94/06623 | | 3/1994 |
| WO | WO 98/50481 | | 11/1998 |
| WO | WO 00/73053 | | 12/2000 |
| WO | WO 03/031170 | | 4/2003 |
| WO | WO 03/072344 | | 9/2003 |

OTHER PUBLICATIONS

Vreeland, et al., "Substrata thermal molding, Part 2: Putting theory to practice" *Tappi Journal* (Nov. 1989), pp. 201-206.
PCT International Search Report mailed Oct. 10, 2005.

* cited by examiner

PROCESS FOR PRODUCING DEEP-NESTED EMBOSSED PAPER PRODUCTS

CROSS REFERENCE TO RELATED APPLICATIONS

This application is a continuation-in-part application of U.S. patent application Ser. No. 11/130,876 filed May 17, 2005, which claims the benefit of U.S. Provisional Application No. 60/573,727 filed on May 21, 2004.

FIELD OF THE INVENTION

The present invention relates to an improved process for producing deep-nested embossed paper products, resulting in significantly less deterioration in paper strength through the embossing process.

BACKGROUND OF THE INVENTION

The embossing of paper products to make those products more absorbent, softer and bulkier, over unembossed products, is well known in the art. Embossing technology has included pin-to-pin embossing where protrusions on the respective embossing rolls are matched such that the tops of the protrusion contact each other through the paper product, thereby compressing the fibrous structure of the product. The technology has also included male-female embossing, or nested embossing, where protrusions of one or both rolls are aligned with either a non-protrusion area or a female recession in the other roll. U.S. Pat. No. 4,921,034, issued to Burgess et al. on May 1, 1990 provides additional background on embossing technologies.

Deep-nested embossing of multiply tissue products is taught in U.S. Pat. Nos. 5,686,168 issued to Laurent et al. on Nov. 11, 1997; 5,294,475 issued to McNeil on Mar. 15, 1994; U.S. patent application Ser. No. 11/059,986; and U.S. patent application Ser. No. 10/700,131. While these technologies have been useful in improving glue bonding of multiply tissues and in providing new aesthetic images on paper products, manufacturers have observed that when producing certain deep nested embossed patterns the resulting paper loses a significant amount of its strength through the embossing process. This undesirable loss of strength is exacerbated as the depth of the embossing is increased. As expected, paper products having this lower strength detract from the acceptance of the product despite the improved aesthetic impression of the deep nested embossing.

Manufacturers have been forced to temper their desire for a deeply embossed tissue by their inability to maintain the papermaking strength through the embossing step. It was recently been found that a new embossing apparatus comprising rounded embossing protrusions can provide a deep-nested embossed paper product which maintains more of its initial strength after going through the embossing process. Now, it has also been found that a process for manufacturing deep-nested embossed paper products comprising the step of conditioning the paper before it is embossed to change the characteristics of the paper to make it more plastic increases the resulting average embossment height at a given emboss knob depth of engagement. Therefore, by the addition of this conditioning step a more dramatic aesthetic emboss may be achieved without increasing engagement, thereby avoiding a corresponding loss of strength. Alternatively, a manufacturer can obtain a constant average emboss height at a lower emboss engagement and obtaining a corresponding higher strength in the product.

SUMMARY OF THE INVENTION

The present invention relates to processes for producing a deep-nested embossed paper products. The invention relates to a process for producing a deep-nested embossed paper products comprising one or more plies of paper where the resulting embossed ply or plies of paper comprise a plurality of embossments having an average embossment height of at least about 650 μm and have a high finished product wet burst strength relative to the unembossed wet strength.

The present invention relates to a process for producing deep-nested embossed paper products comprising the steps of a) delivering one or more plies of paper to a deep-nested embossing process, b) conditioning the one or more plies of paper, wherein the conditioning step comprises heating the one or more plies of paper, adding moisture to the one or more plies of paper, or both heating and adding moisture to the one or more plies of paper, and c) embossing the one or more plies of the paper where the resulting embossed ply or plies of paper comprise a plurality of embossments having an average embossment height of at least about 650 μm.

The embossing apparatus may comprise a cylinder having a plurality of protrusions, or embossing knobs, on its surface. The plurality of protrusions on each cylinder are disposed in a non-random pattern where the respective non-random patterns are coordinated to each other. The two embossing cylinders are aligned such that the respective coordinated non-random pattern of protrusions nest together such that the protrusions engage each other to a depth of greater than about 1.016 mm. The protrusions each comprise a top plane and sidewalls, with the top plane and sidewalls meeting at a protrusion corner. In a preferred apparatus, the protrusion corners of the protrusions of the embossing cylinders of the apparatus of the present invention have a radius of curvature ranging from about 0.076 mm to about 1.778 mm.

DETAILED DESCRIPTION OF THE INVENTION

Figure 1:
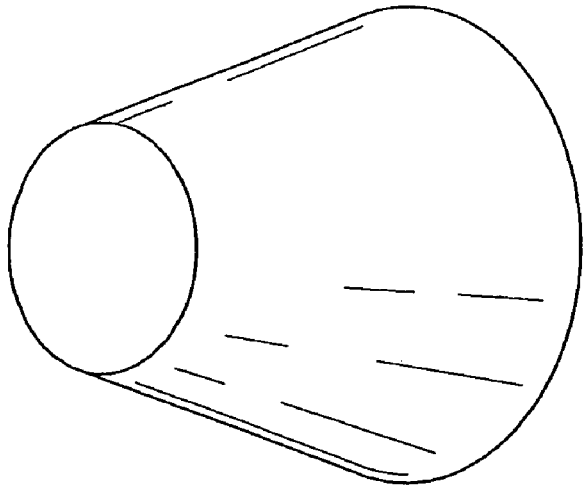
FIG. 1 is a perspective view of a prior art embossing protrusion or knob for use on the surface of the embossing cylinders of a typical embossing apparatus.
Figure 2:
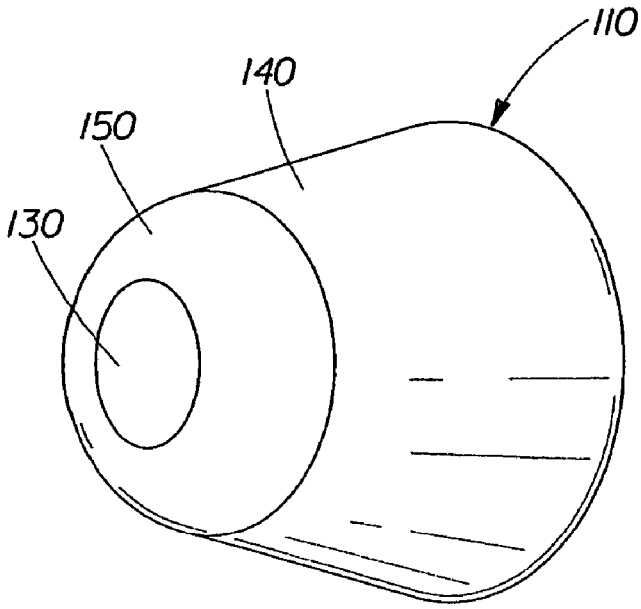
FIG. 2 is a perspective view of the embossing protrusion used on the surface of the embossing cylinder of the apparatus of the present invention.

The process for producing a deep-nested embossed paper product of the present invention comprises the steps of a) delivering one or more plies of paper to an embossing apparatus; b) conditioning the one or more plies of paper, wherein the conditioning step comprises heating the one or more plies of paper, adding moisture to the one or more plies of paper, or both heating and adding moisture to the one or more plies of paper; and c) embossing the one or more plies of the paper through a nip between two embossing cylinders, each cylinder having a plurality of protrusions disposed in a non-random pattern, where the respective non-random patterns are coordinated to each other, wherein the two embossing cylinders are aligned such that the respective coordinated non-random pattern of protrusions nest together such that the protrusions engage each other to a depth of greater than about 1.016 mm.

The process of the present invention acts on one or more plies of paper which are delivered to an embossing apparatus. The term "ply" as used herein means an individual web of fibrous structure having the use as a tissue product. As used herein, the ply may comprise one or more wet-laid or air-laid layers. When more than one layer is used, it is not necessary that they are made from the same fibrous structure. Further, the layers may or may not be homogeneous within the layer. Thus, the different plies can be made from different materials, such as from different fibers, different combinations of fibers, natural and synthetic fibers or any other combination of materials making up the base plies. Further, the resulting web may include one or more plies of a cellulosic web and/or one or more plies of a web made from non-cellulose materials including polymeric materials, starch based materials and any other natural or synthetic materials suitable for forming fibrous webs. In addition, one or more of the plies may include a nonwoven web, a woven web, a scrim, a film a foil or any other generally planar sheet-like material. Further, one or more of the plies can be embossed with a pattern that is different that one or more of the other plies or can have no embossments at all. The actual make up of the tissue paper ply is determined by the desired benefits of the final tissue-towel paper product.

As used herein, the phrase "tissue-towel paper product" refers to products comprising paper tissue or paper towel technology in general, including but not limited to conventionally felt-pressed or conventional wet pressed tissue paper; pattern densified tissue paper; high-bulk, uncompacted tissue paper, and air-laid tissue paper. Non-limiting examples of tissue-towel paper products include toweling, facial tissue, bath tissue, and table napkins and the like.

The term "fibrous structure" as used herein means an arrangement of fibers produced in any typical papermaking machine known in the art to create the ply of tissue-towel paper. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 disclose layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

The papermaking fibers utilized for the present invention will normally include fibers derived from wood pulp, however, other natural fibrous pulp fibers, such as cotton linters, bagasse, wool fibers, silk fibers, etc., can be utilized and are intended to be within the scope of this invention. Synthetic fibers, such as rayon, polyethylene and polypropylene fibers, may also be utilized in combination with natural fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

The tissue-towel paper product substrate may comprise any tissue-towel paper product known in the industry. Embodiment of these substrates may be made according U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995, and U.S. patent application 2004/0192136A1 published in the name of Gusky et al. on Sep. 30, 2004.

The tissue-towel substrates may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

Conventionally pressed tissue paper and methods for making such paper are known in the art. See commonly assigned U.S. Pat. No. 6,547,928 issued to Bamnholtz et al. on Apr. 15, 2003. One suitable tissue paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified tissue webs are disclosed in U.S. Pat. No. 3,301,746, issued to Sanford, et al. on Jan. 31, 1967; U.S. Pat. No. 3,974,025, issued to Ayers on Aug. 10, 1976; U.S. Pat. No. 4,191,609, issued to on Mar. 4, 1980; and U.S. Pat. No. 4,637,859, issued to on Jan. 20, 1987; U.S. Pat. No. 3,301,746, issued to Sanford, et al. on Jan. 31, 1967; U.S. Pat. No. 3,821,068, issued to Salvucci, Jr. et al. on May 21, 1974; U.S. Pat. No. 3,974,025, issued to Ayers on Aug. 10, 1976; U.S. Pat. No. 3,573,164, issued to Friedberg, et al. on Mar. 30, 1971; U.S. Pat. No. 3,473,576, issued to Amneus on Oct. 21, 1969; U.S. Pat. No. 4,239,065, issued to Trokhan on Dec. 16, 1980; and U.S. Pat. No. 4,528,239, issued to Trokhan on Jul. 9, 1985.

Uncompacted, non pattern-densified tissue paper structures are also contemplated within the scope of the present invention and are described in U.S. Pat. No. 3,812,000 issued to Joseph L. Salvucci, Jr. et al. on May 21, 1974; and U.S. Pat. No. 4,208,459, issued to Henry E. Becker, et al. on Jun. 17, 1980. Uncreped tissue paper as defined in the art are also contemplated. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 issued Aug. 12, 1997.

Other materials can be added to the aqueous papermaking furnish or the embryonic web to impart other desirable characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993.

If permanent wet strength is desired, cationic wet strength resins can be added to the papermaking furnish or to the embryonic web. Suitable types of such resins are described in U.S. Pat. No. 3,700,623, issued on Oct. 24, 1972, and U.S. Pat. No. 3,772,076, issued on Nov. 13, 1973, both to Keim.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

In addition, other chemical softening agents may be used. Suitable chemical softening agents comprise quaternary ammonium compounds including, but not limited to, the well-known dialkyldimethylammonium salts (e.g., ditallowdimethylammonium chloride, ditallowdimethylammonium methyl sulfate, di(hydrogenated tallow)dimethyl ammonium chloride, etc.). Certain variants of these softening agents include mono or diester variations of the before mentioned dialkyldimethylanmuonium salts and ester quaternaries made from the reaction of fatty acid and either methyl diethanol amine and/or triethanol amine, followed by quaternization with methyl chloride or dimethyl sulfate. Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997 discloses filled tissue-towel paper products that are acceptable as substrates for the present invention.

The above listings of optional chemical additives is intended to be merely exemplary in nature, and are not meant to limit the scope of the invention.

The tissue-towel substrates of the present invention may alternatively be manufactured via an air-laid making process. Typical airlaying processes include one or more forming chamgbers that are placed over a moving foraminous surface, such as a forming screen. Fibrous materials and particulate materials are introduced into the forming chamber and a vacuum source is employed to draw an airstream through the forming surface. The air stream deposits the fibers and particulate material onto the moving forming surface. Once the fibers are deposited onto the forming surface, an airlaid web substrate is formed. Once the web exits the forming chambers, the web is passed through one or more compaction devices which increases the density and strength of the web. The density of the web may be increased to between about 0.05 g/cc to about 0.5 g/cc. After compaction, the one or both sides of the web may optionally be sprayed with a bonding material, such as latex compositions or other known water-soluble bonding agents, to add wet and dry strength. If a bonding agent is applied the web must generally be passed through a drying apparatus. An example of one process for making such airlaid paper substrates is found in U.S. Patent Application 2004/0192136A1 filed in the name of Gusky et al. and published on Sep. 30, 2004.

Another class of substrate suitable for use in the process of the present invention is non-woven webs comprising synthetic fibers. Examples of such substrates include but are not limited to textiles (e.g.; woven and non woven fabrics and the like), other non-woven substrates, and paperlike products comprising synthetic or multicomponent fibers. Representative examples of other preferred substrates can be found in U.S. Pat. No. 4,629,643 issued to Curro et al. on Dec. 16, 1986; U.S. Pat. No. 4,609,518 issued to Curro et al. on Sep. 2, 1986; European Patent Application EP A 112 654 filed in the name of Haq; copending U.S. patent application Ser. No. 10/360,038 filed on Feb. 6, 2003 in the name of Trokhan et al.; copending U.S. patent application Ser. No. 10/360,021 filed on Feb. 6, 2003 in the name of Trokhan et al.; copending U.S. patent application Ser. No. 10/192,372 filed in the name of Zink et al. on Jul. 10, 2002; and copending U.S. patent application Ser. No. 10/149,878 filed in the name of Curro et al. on Dec. 20, 2000.

The process of the present invention comprises a step wherein the one of more plies of paper are conditioned before the paper is embossed. The conditioning of the invention is such that the fibrous structure of the paper becomes more plastic in nature contrasted to an elastic condition at room temperature. Conditioning of the paper plies may be achieved by heating the plies, adding moisture to the structure, or both. It has been found that by increasing the plasticity of the paper by increasing the temperature or the moisture level of the plies, the ability of the plies to hold the form from the embossing process increases.

In one embodiment, the paper plies are conditioned such that the paper temperature and moisture content are such that the paper temperature is greater than or equal to the glass transition temperature of the fibrous structure of the web. The glass transition temperature, Tg, is a parameter well known in the art as the temperature at which an amorphous polymer structure changes from a glassy state to a rubbery state. See Pulp and Paper Manufacture, B. Thorpe editor, TAPPI, 3rd Edition, 1991, Vol. 7, p. 460; and J. Vreeland et al., Tappi Journal, 1989, P 139-145.

The plies of the present invention may be conditioned by heating the web of paper. The heating may be performed by any known heating process applicable to paper making, including by not limited to passing the over heated rolls, passing the paper through an heated chamber such as an oven, and exposing the web to a heated gas or super-heated steam. Of course, care must be taken in any heating step not to either approach the combustion point of the paper. Additionally, care must be taken that the heating process does not drive off significant amounts of moisture. Drying during the conditioning step is counter productive to the heating since drying the product tends to make the paper less plastic, instead of the desired more plastic to improve emboss efficiency.

The plies of the present invention may be conditioned by adding moisture to the web of paper. The moisture addition may be performed by any known humidification process, including but not limited to applying a mist or spray of water to the web and passing the web through a high humidity chamber. Care must be taken if the conditioning step is one of adding moisture to the paper, not to add too much moisture to the paper structure. Adding moisture to a point where the moisture content is above 10% will result in crepe relaxation.

The preferred conditioning method is where both heating and moisture addition is performed on the paper web. The two conditioning steps can be done independently, by using a combination of processes discussed above or by the utilization of other processes known in the industry for heating and adding moisture such as applying saturated steam to the paper web. For example the roll of paper to be delivered to the embossing apparatus can be unwound and passed over a steam boom prior to embossing. In such a process, high quality steam is supplied to an application boom at anywhere from 0.5 psi to 10 psi. A typical boom is constructed from stainless steel pipe, capped on one or both ends and comprising a plurality of nozzles. The nozzles are capable of providing a spray of steam upon a passing web of paper as the web passes proximate to the steam boom.

Another process for applying steam to the web is a system providing a pair of dripless steam boxes arranged above and below the plane of the web.

Figure 5:
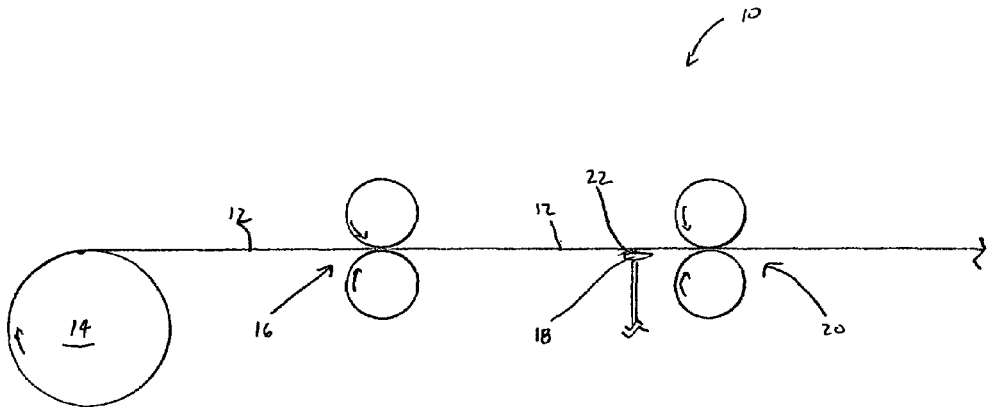
FIG. 5 is a plan view of an exemplary embodiment of a process for the incorporation of a fluid into a passing web material according to the present invention.

Yet another process for applying steam to the web is via the use of an airfoil to expose the web to steam in a controlled manner. FIG. 5 depicts an exemplary method for the application of steam to a web material suitable for use with an embossing process. The process 10 provides for a web material 12 to be unwound from a parent roll 14 and passed between a first nip 16. The web material 12 is then passed proximate to air foil 18 where steam 22 is discharged from air foil 18 and impinges upon, and preferably into, web material 12. In this way, steam 22 is provided with a residence time proximate to web material 12 that is equivalent to the MD dimension of air foil 18. Web materials 12 (such as air laid substrates, single ply substrates, multiple-ply substrates, wet laid substrates, non-woven substrates, woven fabrics, knit fabrics, and combinations thereof) can then be treated in any downstream operation 20 including but not limited to rubber to steel embossing, matched steel embossing, deep nested embossing, compaction, softening, micro-contraction, and combinations thereof.

Figure 6:
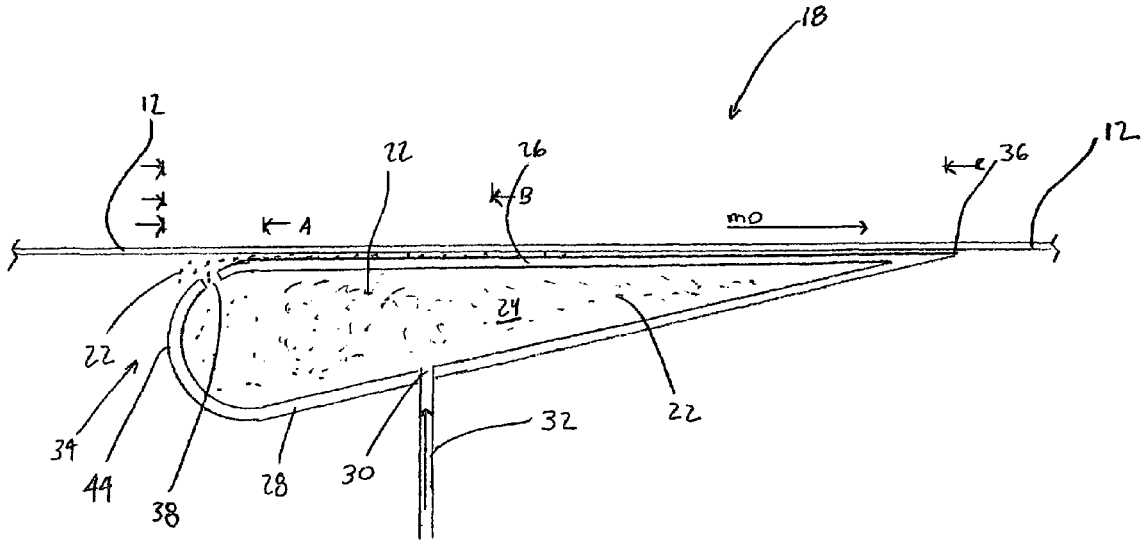
FIG. 6 is cross-sectional view of an exemplary embodiment of a device to provide for the incorporation of a fluid into a passing web material.

As can be seen from FIG. 6, air foil 18 is provided with leading edge 34 and trailing edge 36. Web material 12 approaches proximate air foil 18 and is coincident with air foil 18 along first surface 26. Steam 22 is provided along conduit 32 to air foil 18 through region 30 and is contained within internal region 24 of air foil 18. Steam 22 contained within internal region 24 of air foil 18 is then provided with sufficient pressure to enable steam 24 to exit air foil 18 through aperture 38 proximate to the leading edge 34. As web material 12 approaches proximate air foil 18, boundary layer air proximate to web foil 12 is directed aerodynamically and fluidly past leading edge 34 to the second surface 28 of air foil 18. Removal of boundary layer air from web material 12 proximate to leading edge 34 of air foil 18 then facilitates the migration and/or fluid transmission of steam 22 through region 38 to a position external to air foil 18 and in contact with web material 12. If web material 12 is provided with a machine direction tension, the migration of steam 22 into the web material 12 proximate to air foil 18 along the first surface 26 can be coincident with the movement of web material 12 past first surface 26 of air foil 18. Therefore, steam 22 should remain proximate to web material 12 for the distance that web material 12 traverses from leading edge 34 to trailing edge 36 of air foil 18. A higher speed web material 12 may require air foil 18 to have an increased MD dimension in order to provide for adequate residence time for steam 22 to remain proximate to air foil 18.

The embossing step of the present invention may be performed on any deep-nested embossing equipment known in the industry. The present invention may utilize the apparatus of FIG. 1 for producing a deep-nested embossed paper product 20 comprising two embossing cylinders 100 and 200 each rotatable on an axis, the axes being parallel to one another. Each cylinder has a plurality of protrusions 110 and 210, or embossing knobs, on its surface. The plurality of protrusions on each cylinder are disposed in a non-random pattern where the respective non-random patterns are coordinated with each other. The two embossing cylinders 100 and 200 are aligned such that the respective coordinated non-random pattern of protrusions 110 and 210 nest together such that the protrusions engage each other. The protrusions each comprise a top plane 130 and 230 and sidewalls 140 and 240, with the top plane and sidewalls meeting at a protrusion corner 150 and 250. The protrusion corners of the protrusions of the embossing cylinders of the apparatus of the present invention have a radius of curvature r.

Figure 3:
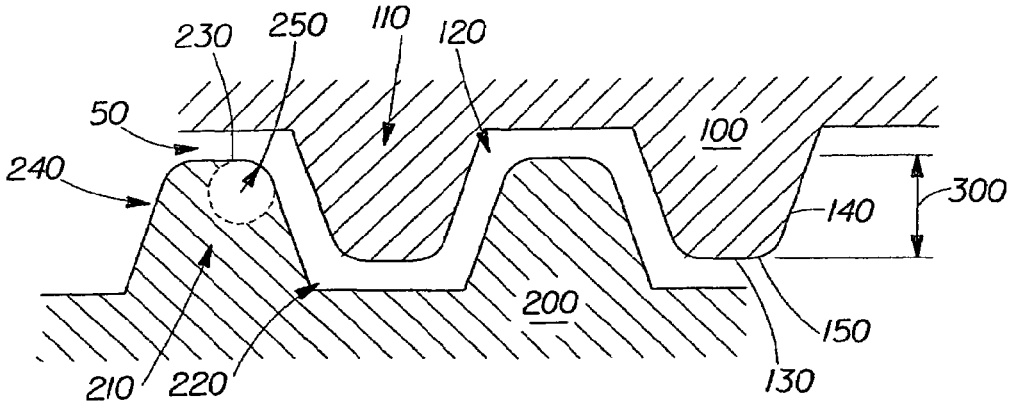
FIG. 3 is a side view of the gap between two engaged emboss cylinders of the apparatus for deep-nested embossing of the present invention.

The apparatus of the present invention can be used to emboss one or more plies of paper, thereby imparting a third, depth dimension to the previously essentially flat paper. The apparatus may be based on any embossing equipment known in the industry. The apparatus is particularly advantageous in producing deep-nested embossed products. As depicted in FIG. 3, by "deep-nested embossing" it is meant that the embossing process utilizes paired emboss rolls, or cylinders, 100 and 200 where the respective protrusions 110 and 210 are coordinatedly matched such that the protrusions of one roll fit into some of the space between the protrusions of the other roll 120 and 220.

The apparatus may be contained within a typical embossing device housing and may comprise two embossing cylinders 100 and 200, each rotatable around its axis. The cylinders are typically disposed in the apparatus with their axes parallel to each other. Each cylinder has an outer surface comprising a plurality of protrusions 110 and 210, also known as emboss knobs, arranged in a non-random pattern. The surface, including the protrusions, may be made out of any material typically used for embossing rolls. Such materials include, without limitation, steel, ebonite, and hard rubber. The non-random protrusion patterns on the first and second cylinders are coordinated such that the protrusions deep-nest as described above. The protrusions comprise a top plane 130 and 230 and sidewalls 140 and 240, with the top plane and sidewalls meeting at a protrusion corner 150 and 250. The knobs may have any cross-sectional shape, but circular or elliptical shapes are most typical for use in embossing paper.

The deep-nested emboss process requires that the protrusions of the two emboss cylinders engage such that the top surface 130 of one cylinder extends into the space 220 between the protrusions 210 of the other cylinder beyond the tops 230 of the protrusions. The depth of the engagement 300 may vary depending on the level of embossing desired on the final paper product. The depth of engagement 300 may vary depending on the level of embossing desired on the final product. Typical embodiments have a depth of engagement 300 greater than about 1.016 mm, greater than about 1.270 mm, greater than about 1.524 mm, or greater than about 2.032 mm. The paper to be embossed is passed through the nip 50 formed between the engaged cylinders.

In a preferred apparatus, the corners of the protrusions 150 and 250, between the top plane and the sidewall, of the present invention are rounded and have a radius of curvature r. The radius of curvature r is typically greater than about 0.076 mm. Other embodiments have radii of curvatures greater than 0.127 mm, greater than 0.254 mm, or greater than about 0.508 mm. The radius of curvature r of the protrusion corners is less than about 1.778 mm. Other embodiments have radii of curvatures less than about 1.524 mm or less than about 1.016 mm.

In other embodiments, at least a portion of the distal end of one or more of the embossing elements other than the protrusion corners can be generally non-planar, including for example, generally curved. Thus, the entire surface of the embossing element spanning between the sidewalls can be non-planar, for example curved. The non-planar surface can take on any shape, including, but not limited to smooth curves or curves, as described above, that are actually a number of straight line or irregular cuts to provide the non-planar surface.

Although not wishing to be bound by theory, it is believed that rounding the protrusion corners or any portion of the distal ends of the embossing elements can provide the resulting paper with embossments that are more blunt with fewer rough edges. Thus, the resulting paper may be provided with a smoother and/or softer look and feel.

The "rounding" of the edge of the corner typically results in a circular arc rounded corner, from which a radius of curvature is easily determined as a traditional radius of the arc. The present invention, however, also contemplates corner configurations which approximate an arc rounding by having the edge of the corner removed by one or more straight line or irregular cut lines. The radius of curvature is determined by determining a best fit circular arc through the protrusion corner.

The resulting embossed paper can have embossments having an average embossment height of at least about 650 μm. Other embodiment may have embossment having embossment heights greater than 1000 μm, greater than about 1250 μm, or greater than about 1400 μm. The average embossment height is measured by the Embossment Height Test Method using a GFM Primos Optical Profiler as described in the Test Method section below.

The wet burst strength of the finished embossed product is measured by the Wet Burst Strength Test Method below. The product made by the process of the present invention can have a wet burst strength of greater than about 85% of the unembossed wet strength, greater than 90%, or greater than about 92%.

Figure 4:
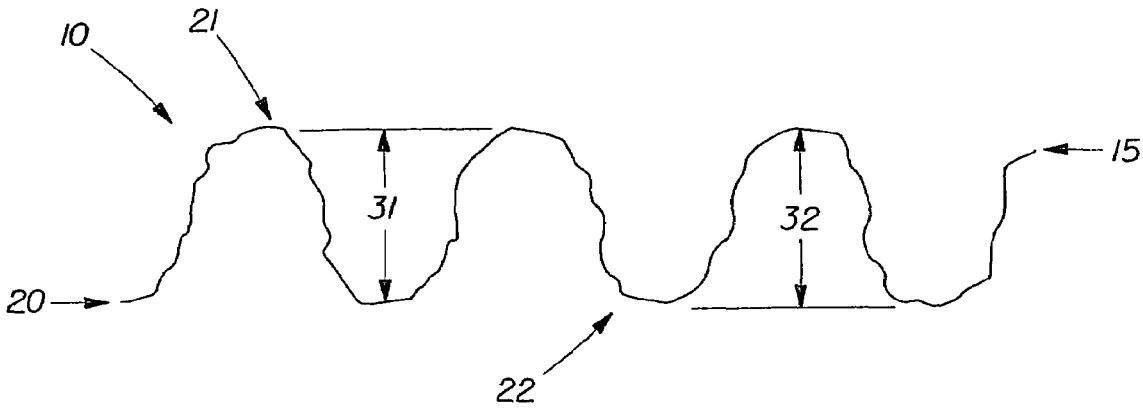
FIG. 4 is a side view of an embodiment of the embossed tissue-towel paper product produced by the apparatus or process of the present invention.

One example of an embossed paper product is shown in FIG. 4. The embossed paper product 10 comprises one or more plies of tissue structure 15, wherein at least one of the plies comprises a plurality of embossments 20. The ply or plies which are embossed are embossed in a deep nested embossing process such that the embossments exhibits an embossment height 31 of at least about 650 μm, at least 1000 μm, at least about 1250 μm, or at least about 1400 μm. The embossment height 31 of the tissue-towel paper product is measured by the Embossment Height Test method.

EXAMPLES

Example 1

One example of the process of the present invention useful in producing an embossed tissue-towel paper product is where a through-air dried (TAD), differential density structure described in U.S. Pat. No. 4,528,239 is delivered to the conditioning and embossing steps. Such a structure may be formed by the following process.

A pilot scale Fourdrinier, through-air-dried papermaking machine is used in the practice of this invention. A slurry of papermaking fibers is pumped to the headbox at a consistency of about 0.15%. The slurry consists of about 65% Northern Softwood Kraft fibers and about 35% unrefined Southern Softwood Kraft fibers. The fiber slurry contains a cationic polyamine-epichlorohydrin wet strength resin at a concentration of about 12.5 kg per metric ton of dry fiber, and carboxymethyl cellulose at a concentration of about 3.25 kg per metric ton of dry fiber.

Dewatering occurs through the Fourdrinier wire and is assisted by vacuum boxes. The wire is of a configuration having 33.1 machine direction and 30.7 cross direction filaments per cm, such as that available from Albany International known at 84×78-M.

The embryonic wet web is transferred from the Fourdrinier wire at a fiber consistency of about 22% at the point of transfer, to a TAD carrier fabric. The wire speed is about 195 meters per minute. The carrier fabric speed is about 183 meters per minute. Since the wire speed is about 6% faster than the carrier fabric, shortening of the web occurs at the transfer point. Thus, the wet web foreshortening is 6%. The sheet side of the carrier fabric consists of a continuous, patterned network of photopolymer resin, said pattern containing about 130 deflection conduits per cm. The deflection conduits are arranged in a bi-axially staggered configuration, and the polymer network covers about 25% of the surface area of the carrier fabric. The polymer resin is supported by and attached to a woven support member consisting of 27.6 machine direction and 13.8 cross direction filaments per cm. The photopolymer network rises about 0.203 mm above the support member.

The consistency of the web is about 65% after the action of the TAD dryers operating about a 232° C., before transfer onto the Yankee dryer. An aqueous solution of creping adhesive consisting of polyvinyl alcohol is applied to the Yankee surface by spray applicators at a rate of about 2.5 kg per metric ton of production. The Yankee dryer is operated at a speed of about 183 meters per minute. The fiber consistency is increased to an estimated 99% before creping the web with a doctor blade. The doctor blade has a bevel angle of about 25 degrees and is positioned with respect to the Yankee dryer to provide an impact angle of about 81 degrees. The Yankee dryer is operated at about 157° C., and Yankee hoods are operated at about 177° C.

The dry, creped web is passed between two calendar rolls and rolled on a reel operated at 165 meters per minute, so that there is about 16% foreshortening of the web by crepe; 6% wet microcontraction and an additional 10% dry crepe. The resulting paper has a basis weight of about 24 grams per square meter (gsm).

The paper described above collected on the reel is then conditioned in a process wherein the roll is unwound and run via a path to the embossing apparatus, where between the unwind and the embossing apparatus the one or more plies of paper is passed over a steam boom where high quality 7.5 psi steam is sprayed on the web. The condition of the web is increased from a temperature of 75° F. and 5% moisture content to a condition of 94° F. and 5.5% moisture content.

The paper described above is then subjected to the deep embossing process of this invention. Two emboss cylinders are engraved with complimentary, nesting protrusions shown in FIG. 3. The cylinders are mounted in the apparatus with their respective axes being parallel to one another. The protrusions are frustaconical in shape, with a face (top or distal—i.e. away from the roll from which they protrude) diameter of about 1.52 mm and a floor (bottom or proximal—i.e. closest to the surface of the roll from which they protrude) diameter of about 0.48 mm. The height of the protrusions on each roll is about 3.05 mm. The radius of curvature is about 0.76 mm. The engagement of the nested rolls is set to about 2.49 mm, and the paper described above is fed through the engaged gap at a speed of about 36.6 meters per minute. The resulting paper has an embossment height of greater than 650 μm, a finished product wet burst strength greater than about 85% of its unembossed wet strength.

Example 2

Another example of the process of the present invention useful in producing an embossed tissue-towel paper product is where an alternate through-air-dried (TAD), differential density structure described in U.S. Pat. No. 4,528,239 is delivered to the conditioning and embossing steps. Such a structure may be formed by the following process.

A Fourdrinier, through-air-dried papermaking machine is used in the practice of this invention. A slurry of papermaking fibers is pumped to the headbox at a consistency of about 0.15%. The slurry consists of about 55% Northern Softwood Kraft fibers, about 30% unrefined Eucalyptus fibers and about 15% repulped product broke. The fiber slurry contains a cationic polyamine-epichlorohydrin wet burst strength resin at a concentration of about 10.0 kg per metric ton of dry fiber, and carboxymethyl cellulose at a concentration of about 3.5 kg per metric ton of dry fiber.

Dewatering occurs through the Fourdrinier wire and is assisted by vacuum boxes. The wire is of a configuration having 41.7 machine direction and 42.5 cross direction filaments per cm, such as that available from Asten Johnson known as a "786 wire".

The embryonic wet web is transferred from the Fourdrinier wire at a fiber consistency of about 22% at the point of transfer, to a TAD carrier fabric. The wire speed is about 660 meters per minute. The carrier fabric speed is about 635 meters per minute. Since the wire speed is about 4% faster than the carrier fabric, wet shortening of the web occurs at the transfer point. Thus, the wet web foreshortening is about 4%. The sheet side of the carrier fabric consists of a continuous, patterned network of photopolymer resin, the pattern containing about 90 deflection conduits per inch. The deflection conduits are arranged in an amorphous configuration, and the polymer network covers about 25% of the surface area of the carrier fabric. The polymer resin is supported by and attached to a woven support member having of 27.6 machine direction and 11.8 cross direction filaments per cm. The photopolymer network rises about 0.43 mm above the support member.

The consistency of the web is about 65% after the action of the TAD dryers operating about a 254° C., before transfer onto the Yankee dryer. An aqueous solution of creping adhesive consisting of animal glue and polyvinyl alcohol is applied to the Yankee surface by spray applicators at a rate of about 0.66 kg per metric ton of production. The Yankee dryer is operated at a speed of about 635 meters per minute. The fiber consistency is increased to an estimated 95.5% before creping the web with a doctor blade. The doctor blade has a bevel angle of about 33 degrees and is positioned with respect to the Yankee dryer to provide an impact angle of about 87 degrees. The Yankee dryer is operated at about 157° C., and Yankee hoods are operated at about 120° C.

The dry, creped web is passed between two calendar rolls and rolled on a reel operated at 606 meters per minute so that there is about 9% foreshortening of the web by crepe; about 4% wet microcontraction and an additional 5% dry crepe. The resulting paper has a basis weight of about 23 grams per square meter (gsm).

The paper described above collected on the reel is then conditioned in a process wherein the roll is unwound and run via a path to the embossing apparatus, where between the unwind and the embossing apparatus the one or more plies of paper is passed proximate to a steam air foil where high quality 7.5 psi steam is sprayed on the web. The condition of the web is increased from a temperature of 75° F. and 5% moisture content to a condition of 115° F. and 7% moisture content.

The paper described above is then subjected to the deep embossing process of this invention. Two emboss cylinders are engraved with complimentary, nesting protrusions shown in FIG. 3. The cylinders are mounted in the apparatus with their respective axes being parallel to one another. The protrusions are frustaconical in shape, with a face (top or distal—i.e. away from the roll from which they protrude) diameter of about 1.52 mm and a floor (bottom or proximal—i.e. closest to the surface of the roll from which they protrude) diameter of about 0.48 mm. The height of the protrusions on each roll is about 3.05 mm. The radius of curvature is about 0.76 mm. The engagement of the nested rolls is set to about 2.49 mm, and the paper described above is fed through the engaged gap at a speed of about 36.6 meters per minute. The resulting paper has an embossment height of greater than 650 μm, a finished product wet burst strength greater than about 85% of its unembossed wet strength.

Example 3

In another example of the process of the present invention, two separate paper plies are made from the paper making process of Example 2. The two plies are then combined and then conditioned by the steam boom process and embossed by the deep nested embossing process of Embodiment 1. The resulting paper has a web temperature of 94° F. and a moisture content of 5.5% before embossing and embossment height of greater than 650 μm, a finished product wet burst strength greater than about 85% of its unembossed wet strength after embossing.

Example 4

In another example of the process of the present invention, three separate paper plies are made from the paper making process of Example 2. Two of the plies are conditioned by the steam boom process of Example 1 and then deep nested embossed by the deep nested embossing process of the Example. The resulting paper of the two conditioned and embossed webs has a web temperature of 94° F. and a moisture content of 5.5% before embossing and an embossment height of greater than 650 μm, a finished product wet burst strength greater than about 85% of its unembossed wet strength after embossing. The three plies of tissue paper are then combined in a standard converting process such that the two embossed plies are the respective outer plies and the unembossed ply in the inner ply of the product.

Example 5

In an example the process of the present invention, a through-air dried, differential density structure described in U.S. Pat. No. 4,528,239 be formed by the following process is delivered to the conditioning and embossing steps. The TAD carrier fabric of Example 1 is replaced with a carrier fabric consisting of 88.6 bi-axially staggered deflection conduits per cm, and a resin height of about 0.305 mm. This paper is further subjected to the conditioning and embossing processes of Example 2, and the resulting paper has a web temperature of 115° F. and a moisture content of 7% before embossing and an embossment height of greater than 650 μm, a finished product wet burst strength greater than about 85% of its unembossed wet strength after embossing.

Example 6

In an alternative example of the present process, is where a paper structure having a wet microcontraction greater than about 5% in combination with any known through air dried process is delivered to the conditioning and embossing steps. Wet microcontraction is described in U.S. Pat. No. 4,440,597. An example of embodiment 6 may be produced by the following process.

The wire speed is increased to about 203 meters per minute. The carrier fabric speed is about 183 meters per minute. The wire speed is 10% faster compared to the TAD carrier fabric so that the wet web foreshortening is 10%. The TAD carrier fabric of Example 1 is replaced by a carrier fabric having a 5-shed weave, 14.2 machine direction filaments and 12.6 cross-direction filaments per cm. The Yankee speed is about 183 meters per minute and the reel speed is about 165 meters per minute. The web is foreshortened 10% by wet microcontraction and an additional 10% by dry crepe. The resulting paper prior to embossing has a basis weight of about 33 gsm. This paper is further subjected to the conditioning and embossing processes of Example 2, the resulting paper has a web temperature of 115° F. and a moisture content of 7% before embossing and an embossment height of greater than 650 μm, a finished product wet burst strength greater than about 85% of its unembossed wet strength after embossing.

Example 7

Another example of the present process is where through air dried paper structures having machine direction impression knuckles as described in U.S. Pat. No. 5,672,248 are delivered to the conditioning and embossing steps. A commercially available single-ply substrate made according to U.S. Pat. No. 5,672,248 having a basis weight of about 38 gsm sold under the Trade-name Scott and manufactured by Kimberly Clark Corporation, is subjected to the conditioning and embossing processes of Example 2. This paper is further subjected to the conditioning and embossing processes of Example 2, and the resulting paper has a web temperature of 115° F. and a moisture content of 7% before embossing and an embossment height of greater than 650 μm, a finished product wet burst strength greater than about 85% of its unembossed wet strength after embossing.

Example 8

Another example of the process of the present invention is where an air-laid paper structure as described in U.S. 2004/0192136A1, is delivered to the conditioning and embossing steps of the process. This paper is further subjected to the conditioning and embossing processes of Example 2, and the resulting paper has a web temperature of 115° F. and a moisture content of 7% before embossing and an embossment height of greater than 650 μm, a finished product wet burst strength greater than about 85% of its unembossed wet strength after embossing.

TEST METHODS

Embossment Height Test Method

Embossment height is measured using an Optical 3D Measuring System MikroCAD compact for paper measurement instrument (the "GFM MikroCAD optical profiler instrument") and ODSCAD Version 4.0 software available from GFMesstechnik GmbH, Warthestraβe E21, D14513 Teltow, Berlin, Germany. The GFM MikroCAD optical profiler instrument includes a compact optical measuring sensor based on digital micro-mirror projection, consisting of the following components:

A) A DMD projector with 1024×768 direct digital controlled micro-mirrors.

B) CCD camera with high resolution (1300×1000 pixels).

C) Projection optics adapted to a measuring area of at least 27×22 mm.

D) Recording optics adapted to a measuring area of at least 27×22 mm; a table tripod based on a small hard stone plate; a cold-light source; a measuring, control, and evaluation computer; measuring, control, and evaluation software, and adjusting probes for lateral (X-Y) and vertical (Z) calibration.

E) Schott KL1500 LCD cold light source.

F) Table and tripod based on a small hard stone plate.

G) Measuring, control and evaluation computer.

H) Measuring, control and evaluation software ODSCAD 4.0.

I) Adjusting probes for lateral (x-y) and vertical (z) calibration.

The GFM MikroCAD optical profiler system measures the height of a sample using the digital micro-mirror pattern projection technique. The result of the analysis is a map of surface height (Z) versus X-Y displacement. The system should provide a field of view of 27×22 mm with a resolution of 21 μm. The height resolution is set to between 0.10 μm and 1.00 μm. The height range is 64,000 times the resolution. To measure a fibrous structure sample, the following steps are utilized:

1. Turn on the cold-light source. The settings on the cold-light source are set to provide a reading of at least 2,800 k on the display.
2. Turn on the computer, monitor, and printer, and open the software.
3. Select "Start Measurement" icon from the ODSCAD task bar and then click the "Live Image" button.
4. Obtain a fibrous structure sample that is larger than the equipment field of view and conditioned at a temperature of 73° F.±2° F. (about 23° C.±1° C.) and a relative humidity of 50%±2% for 2 hours. Place the sample under the projection head. Position the projection head to be normal to the sample surface.
5. Adjust the distance between the sample and the projection head for best Focus in the following manner. Turn on the "Show Cross" button. A blue cross should appear on the screen. Click the "Pattern" button repeatedly to project one of the several focusing patterns to aid in achieving the best focus. Select a pattern with a cross hair such as the one with the square. Adjust the focus control until the cross hair is aligned with the blue "cross" on the screen.
6. Adjust image brightness by changing the aperture on the lens through the hole in the side of the projector head and/or altering the camera gains setting on the screen. When the illumination is optimum, the red circle at the bottom of the screen labeled "I.O." will turn green.
7. Select technical surface/rough measurement type.
8. Click on the "Measure" button. When keeping the sample still in order to avoid blurring of the captured image.
9. To move the data into the analysis portion of the software, click on the clipboard/man icon.
10. Click on the icon "Draw Cutting Lines." On the captured image, "draw" six cutting lines (randomly selected) that extend from the center of a positive embossment through the center of a negative embossment to the center of another positive embossment. Click on the icon "Show Sectional Line Diagram." Make sure active line is set to line 1. Move the cross-hairs to the lowest point on the left side of the computer screen image and click the mouse. Then move the cross-hairs to the lowest point on the right side of the computer screen image on the current line and click the mouse. Click on the "Align" button by marked point's icon. Click the mouse on the lowest point on this line and then click the mouse on the highest point of the line. Click the "Vertical" distance icon. Record the distance measurement. Increase the active line to the next line, and repeat the previous steps until all six lines have been measured. Perform this task for four sheets equally spaced throughout the Finished Product Roll, and four finished product rolls for a total of 16 sheets or 96 recorded height values. Take the average of all recorded numbers and report in mm, or μm, as desired. This number is the embossment height.

Wet Burst Strength Method

"Wet Burst Strength" as used herein is a measure of the ability of a fibrous structure and/or a paper product incorporating a fibrous structure to absorb energy, when wet and subjected to deformation normal to the plane of the fibrous structure and/or paper product. Wet burst strength may be measured using a Thwing-Albert Burst Tester Cat. No. 177 equipped with a 2000 g load cell commercially available from Thwing-Albert Instrument Company, Philadelphia, Pa.

For 1-ply and 2-ply products having a sheet length (MD) of approximately 11 inches (280 mm) remove two usable units from the roll. Carefully separate the usable units at the perforations and stack them on top of each other. Cut the usable units in half in the Machine Direction to make a sample stack of four usable units thick. For usable units smaller than 11 inches (280 mm) carefully remove two strips of three usable units from the roll. Stack the strips so that the perforations and edges are coincident. Carefully remove equal portions of each of the end usable units by cutting in the cross direction so that the total length of the center unit plus the remaining portions of the two end usable units is approximately 11 inches (280 mm). Cut the sample stack in half in the machine direction to make a sample stack four usable units thick.

The samples are next oven aged. Carefully attach a small paper clip or clamp at the center of one of the narrow edges. "Fan" the other end of the sample stack to separate the towels which allows circulation of air between them. Suspend each sample stack by a clamp in a 221° F.±2° F. (105° C.±1° C.) forced draft oven for five minutes±10 seconds. After the heating period, remove the sample stack from the oven and cool for a minimum of 3 minutes before testing. Take one sample strip, holding the sample by the narrow cross machine direction edges, dipping the center of the sample into a pan filled with about 25 mm of distilled water. Leave the sample in the water four (4) (±0.5) seconds. Remove and drain for three (3) (±0.5) seconds holding the sample so the water runs off in the cross machine direction. Proceed with the test immediately after the drain step. Place the wet sample on the lower ring of a sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest g.

What is claimed is:

1. A process for producing a deep-nested embossed paper product comprising the steps of:

a) delivering one or more plies of paper to an embossing apparatus;

b) conditioning the one or more plies of paper, wherein the conditioning step comprises heating the one or more plies of paper, or both heating and adding moisture to the one or more plies of paper;

c) embossing the one or more plies of the paper in the embossing apparatus by passing the one or more plies of paper through a nip between two embossing cylinders, each cylinder having a plurality of protrusions disposed in a non-random pattern, where the respective non-random patterns are coordinated to each other, wherein the two embossing cylinders are aligned such that the respective coordinated non-random pattern of protrusions nest together such that the protrusions engage each other to a depth of greater than about 1.016 mm and wherein the protrusions have a radius of curvature of from about 0.076 mm to about 1.778 mm.

2. The process according to claim 1 wherein the paper is a tissue-towel paper.

3. The process according to claim 2 wherein the tissue-towel paper is manufactured by a process selected from the group consisting of wet-laid through-air dried, wet-laid conventionally dried, and air-laid.

4. A process according to claim 1 where the resulting embossed paper has an average embossment height of at least about 650 μm.

5. A process according to claim 4 where the resulting embossed paper has an average embossment height of at least about 1000 μm.

6. A process according to claim 5 where the resulting embossed paper has an average embossment height of at least about 1250 μm.

7. A process according to claim 6 where the resulting embossed paper has an average embossment height of at least about 1400 μm.

8. A process according to claim 1 wherein the plies of paper are conditioned to a point where the temperature of the paper plies is above the glass transition temperature of the paper.

* * * * *